United States Patent [19]

Pyle et al.

[11] 3,955,763

[45] May 11, 1976

[54] ROTATABLE SPRAY NOZZLE

[75] Inventors: Arlon R. Pyle, St. Louis Park; William D. Vork, Edina, both of Minn.

[73] Assignee: Graco Inc., Minneapolis, Minn.

[22] Filed: May 19, 1975

[21] Appl. No.: 578,544

[52] U.S. Cl. ..... 239/119; 239/587; 285/110; 285/261

[51] Int. Cl.[2] ..... B05B 15/02

[58] Field of Search ..... 239/104, 390, 392–394, 239/396, 436, 437, 451, 526, 587, 119, 600; 285/110, 261; 277/12 F, 30, 205; 251/315, 317

[56] References Cited

UNITED STATES PATENTS

| | | | |
|---|---|---|---|
| 787,391 | 4/1905 | Niederlander | 285/110 X |
| 2,929,406 | 3/1960 | Anderson | 251/317 X |
| 3,116,882 | 1/1964 | Vork | 239/394 |
| 3,528,611 | 9/1970 | Watson | 239/119 |
| 3,667,681 | 6/1972 | Blancha | 239/393 |

FOREIGN PATENTS OR APPLICATIONS

| | | | |
|---|---|---|---|
| 513,094 | 2/1955 | Italy | 285/110 |
| 155,216 | 7/1938 | Germany | 239/393 |

*Primary Examiner*—John J. Love
*Assistant Examiner*—Andres Kashnikow
*Attorney, Agent, or Firm*—Paul L. Sjoquist

[57] ABSTRACT

Apparatus is disclosed for attachment to a spraying device, comprising a rotatable ball member having a spray orifice and passage, and a handle formed as an integral part, a housing for enclosing the ball member while allowing the handle portion to project external of the housing, a sealing member for fitting into the housing in sealing contact with the ball member, and a threadable attachment for securing the housing and ball and sealing members to a spraying device so that the ball member may be rotatably moved to place the spray orifice and passage in forward and in reverse contact with the spraying device.

13 Claims, 4 Drawing Figures

ROTATABLE SPRAY NOZZLE

BACKGROUND OF THE INVENTION

This invention relates to a spray nozzle apparatus for use in conjunction with paint spraying guns and the like. More particularly, the invention relates to a rotatable spray nozzle for use on airless spray guns wherein the paint or similar liquid is sprayed under high hydraulic pressures. The invention enables the spray tip to be rotatably adjusted so as to unclog particles which periodically become wedged into the very small spray orifice.

The present invention is useful for the spraying application of paints, lacquers, enamels, mastics, varnishes, and other liquid coating materials which are conveniently applied by a spraying process. The invention facilitates cleaning of the nozzle and spray passages after such spray coating operations have been completed.

This invention is an improvement over prior art apparatus designed to accomplish the same or similar purposes. For example, U.S. Pat. No. 3,116,882 issued Jan. 7, 1964, and owned by the same assignee as the present invention, discloses a turret nozzle which permits the reversal of the flow of the spray coating liquid for purposes of unclogging the spray orifice. The turret nozzle disclosed in the patent requires sealing members between the rear or inlet end of the nozzle and the housing, between the front or outlet end of the nozzle and housing, and also between the rotatable nozzle shaft and the housing. These sealing members enable the prior invention to be rotatably mounted without causing leakage of the sprayed material under the hydraulic pressures to which it is subjected. These pressures may range from 500 pounds per square inch (p.s.i.) to 2,000 p.s.i.

The prinicpal problem which must be overcome in the design of a rotatable spray nozzle, where high hydraulic pressures are encountered, is to provide an adequate sealing means which will prevent fluid leakage, even after repeated rotations of the spray nozzle and periodic instances of breaking the seal connection because of removal of the nozzle from the spray gun for cleaning, replacement, etc. The prior art solves this problem by means of providing multiple seals at all points where hydraulic pressure is or may be felt. The wearing of any of these sealing members of the prior art will cause the spray nozzle to begin leaking.

SUMMARY OF THE INVENTION

The present invention comprises a rotatable spray nozzle formed of only three essential parts. The first part comprises a spherical ball spray tip holder having a passage therethrough, and having an elongated handle formed therefrom. The second part comprises a nozzle holder for enclosing the rotatable spray nozzle and providing a means for securing the assembly against the spray gun, the holder having a complementary shaped spherical interior surface for bearing against the rotatable first part. The third part comprises a deformable seal member of novel design for seating against the rear spherical surface of the rotatable nozzle. Of course, a suitable spray tip, typically made of carbide steel material, is rigidly secured inside the passage through the spherical ball part of the invention, and a suitable fastening means is provided for attaching the entire apparatus to a spraying device.

BRIEF DESCRIPTION OF THE DRAWING

A preferred embodiment of the present invention is shown on the attached drawing in which.

DESCRIPTION OF THE PREFERRED EMBODIMENT

Figure 1:
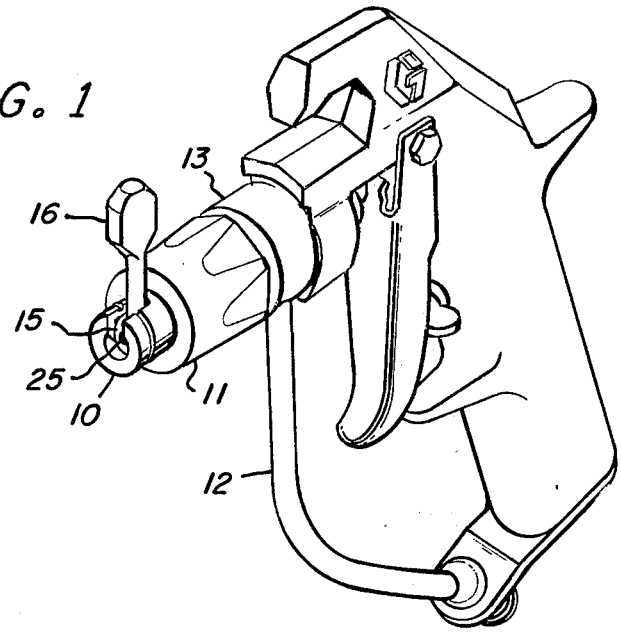
FIG. 1 illustrates an isometric view of the invention attached to a spray gun.

Referring first to FIG. 1, the invention is shown in isometric view attached to a paint spray gun. The spray gun may be any of a number of paint spray guns known and commercially used, as for example, the "Silver" model spray gun manufactured by the assignee of the present invention. Paint under high hydraulic pressure is delivered to the spray nozzle via a spray conduit 12 which is attached to spray gun 13. Passages internal to spray gun 13 transfer the paint supplied through conduit 12 to and through the spray nozzle in a manner which will be hereinafter described. A handle 16 projects outwardly from a slotted portion of nozzle holder 10 and the interior surface of nozzle holder 10 is machined for seating and securing a spherical and rotatable nozzle 15. The nozzle assembly is threadably secured to spray gun 13 by means of a tip nut 11 having internal threads matched to similar threads on spray gun 13.

Figure 2:
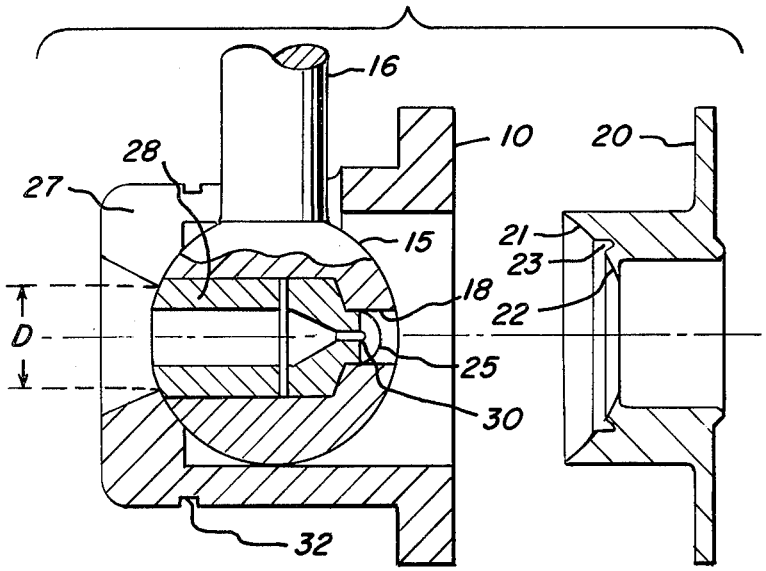
FIG. 2 shows the inventive components in cross section.

FIG. 2 shows the three essential components of the invention in side view and in cross section. Handle 16 forms a projection of spherical nozzle 15. Handle 16 and nozzle 15 are formed by machining or other similar process from a single piece of steel stock. A passage 18, having a major and minor diameter, is drilled through nozzle 15 for purposes of inserting and affixing a suitable spray tip 25. The insertion and affixing of spray tip 25 is done according to procedures which are well known in the prior art, and may include force fitting or interference fitting, welding, or other techniques. The major diameter of passage 18 is selected for a force fit of the spray tip 25 and sleeve 28. The minor diameter of passage 18 is smaller than its major diameter so that sleeve 28 and/or spray tip 25 cannot be expelled from the apparatus even under the highest hydraulic pressure forces which may be encountered. The cone-shaped recess in the front of nozzle holder 10 has a minimum interior diameter "D" which is smaller than the major diameter of passage 18, and which is slightly larger than the diameter of the cylindrical portion of handle 16.

It is important that the forward end of spray tip 25 be recessed slightly within the passage 18 so as not to project outwardly beyond the radius of curvature of rotatable nozzle 15. Spray tip 25 will typically have a machined orifice, usually of elliptical shape when viewed from the front, which is designed to control the spray pattern characteristics. The major axis orientation of this elliptical orifice may be either in alignment with handle 16 or perpendicular thereto. If the major axis of this orifice is aligned with handle 16 then the preferred attachment of the apparatus to spray gun 13 is as illustrated in FIG. 1. However, if the major axis of the orifice on spray tip 25 is aligned perpendicular to the handle 16, then the preferred attachment of the apparatus to spray gun 13 is one wherein handle 16 projects sidewardly out from the spray gun.

Sealing member 20 is constructed from a deformable plastic such as acetal homopolymer which has good wear characteristics. Seal 20 has two spherical annular bearing surface segments 21 and 22 separated by a circular notch 23. Bearing surfaces 21 and 22 are constructed of a spherical radius slightly larger than the corresponding radius of nozzle 15. For example, in the preferred embodiment nozzle 15 has a spherical diameter of 0.435 inch, and bearing surfaces 21 and 22 have a spherical radius of 0.250 inch. This results in a non-mating fit between the nozzle and seal 20 when the assembly is not threadably secured to the spray gun, and therefore tends to allow freer rotation of nozzle 15. However, when the assembly is threadably secured to the spray gun, bearing surfaces 21 and 22 deform into mating relationship with nozzle 15 and thereby form a tight fluid seal. Bearing surface 22 is a spherical planar extension of bearing surface 21 separated by gap 23 to provide an annular gap in which deformation of the sealing members may occur. Thus, bearing surfaces 21 and 22 tend to be in non-sealing relationship with nozzle 15 whenever the apparatus is not threadably secured to the spray gun, but both tend to deform into sealing relationship with nozzle 15 upon the tightening of the apparatus against the spray gun. In the process of this tightening, annular gap 23 becomes narrowed, being filled in by the deformed bearing surfaces 21 and 22.

Sleeve 28 is force fit into the major diameter of passage 18 during assembly of the apparatus, and its initial length is chosen so that it projects out beyond the spherical diameter of nozzle 15. The projection of sleeve 28 is then ground down into a spherical match with the surface of nozzle 15. Sleeve 28 has an internal diameter which substantially matches the spray tip 25 near cavity diameter to create a smooth flow passage into the rear of spray tip 25. It is advantageous to keep the internal diameter of sleeve 28 as small as practicable, because hydraulic fluid pressure can create shear stresses against the edge portion of seal member 20 which becomes exposed and uncovered by the sleeve internal diameter as nozzle 15 is rotated. Further, it is imperative that the internal diameter of sleeve 28, as well as the minor diameter of passage 18, be made smaller than the spherical arc length of the bearing surface of sealing member 20. This is required in order that the nozzle 15 cannot be rotated into a position where either of these diameters bridge the entire bearing surface of sealing member 20. If such a bridging were to occur the extremely high hydraulic pressures inside the apparatus would force a fluid flow through the gap created by the bridging diameter and would rapidly erode the adjacent bearing surface of sealing member 20. In the preferred embodiment of the invention the interior diameter of sleeve 28 is made substantially equal to the minor diameter of passage 18, and sealing member 20 is designed to have an undeformed bearing surface spherical measurement greater than the diameter size. Of course, the spherical surface length increases when the sealing member 20 is tightened and deformed against nozzle 15, to provide a further measure of safety in this regard.

Figure 3:
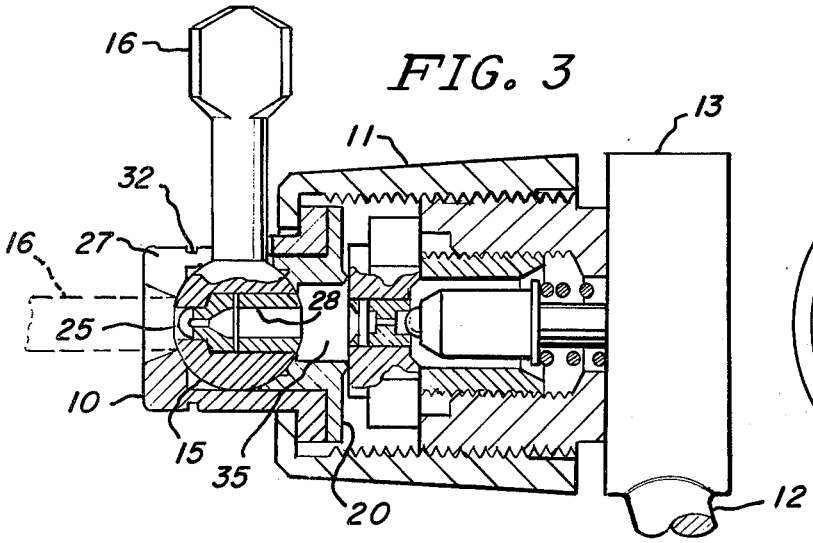
FIG. 3 shows the invention in partial cross section attached to a spray gun.

FIG. 3 illustrates the apparatus in side view and partial cross section to show the components in sealing relationship relative to the spray gun. Tip nut 11 threadably secures against a shoulder or flange on nozzle holder 10. A similar shoulder or flange on sealing member 20 thereby becomes compressed against the front surface of spray gun 13 to deform sealing member 20 as hereinbefore described and provide a complete hydraulic seal around the input end of nozzle 15. This hydraulic seal eliminates the necessity for providing any sealing member around the projecting portion of handle 16, as well as the forward spherical surface of nozzle 15 which bears against the mating surface on nozzle holder 10.

FIG. 3 also illustrates, in dotted outline, the manner in which the component parts of the apparatus may be assembled. For assembly, handle 16 is moved forwardly and fitted through a slot 27 in nozzle holder 10. The handle 16 is sized so as to fit through the opening created by slot 27, which is equal in width to diameter "D" (FIG. 2), whereby handle 16 may be inserted from the rear and pulled forwardly and upwardly to seat nozzle 15 in its preferred location within holder 10. Once this has been done, sealing member 20 may be inserted behind holder 10 and the entire apparatus may be threadably secured to the spray gun by means of tip nut 11.

One of the inherent advantages of the invention is apparent from FIG. 3, in that the interior volume in chamber 35 between valve 36 and spray tip 25 is minimized. Prior art devices generally require that this volume be significantly greater because of their size and sealing design, with the net result that a greater quantity of fluid can accumulate therein. When spray valve 36 is opened this accumulate fluid is forced out through spray tip 25 under a reduced, but rapidly increasing, pressure with the result that it tends to sputter through the orifice 30 in droplets rather than as a fine spray. This condition, commonly called "spitting" in the industry, is disadvantageous to the extent that the larger droplets reach the work piece being sprayed, because they impair the quality of the spray finish. The reduced volume of chamber 35 in the present invention provides for a lesser accumulation of fluid and therefore reduces the tendency of the invention to be the cause of "spitting."

Figure 4:
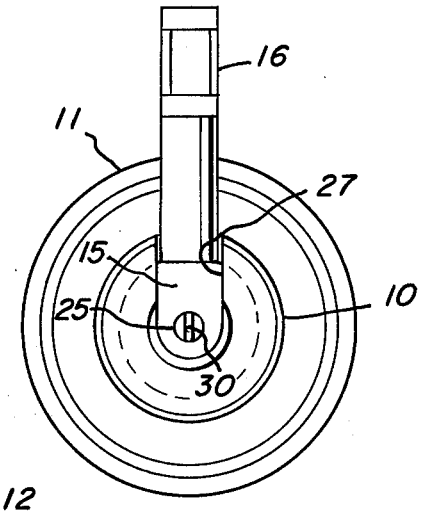
FIG. 4 shows the front view of the invention.

FIG. 4 illustrates the invention in front view, showing the relationship between handle 16 and slot 27. In this figure the major axis orientation of spray orifice 30 is in alignment with handle 16. The alternative embodiment of the invention would require that the major axis of spray orifice 30 be perpendicularly aligned relative to handle 16, and then handle 16 would be secured against spray gun 13 in a sidewise manner as hereinbefore described.

Nozzle holder 10 has a circumferential slot 32 which enable the present invention to be used in conjunction with a Safety Tip Guard disclosed in U.S. Pat. application Ser. No. 532,021, filed Dec. 12, 1974, and assigned to the same assignee as the present invention. The safety spray guard of that invention may be suitably notched to provide a passage for handle 16, and the invention may then be used in conjunction with the present invention as in the manner described in the copending application.

In operation, the present invention may be secured by means of tip nut 11 into a forwardly directed spray position as illustrated in FIG. 3. The spraying liquid is then emitted through the front of the spray nozzle for normal usage. In the event a particle becomes clogged in the spray passage, the spray gun trigger is disengaged and tip nut 11 may be loosened slightly to release the seal between sealing member 20 and nozzle 15. Handle 16 is then rotated 180° to face the spray orifice rearwardly toward the spray gun. Tip nut 11 is again tightened and the spray gun trigger is depressed. This causes the full hydraulic pressure of the spray liquid to be applied in a reverse direction through the spray orifice and associated passages, and in most cases is sufficient to dislodge the obstruction and blow it forwardly from the spray gun. The spray gun trigger is again released, tip nut 11 is loosened slightly so that handle 16 may be rotated back to its original position, and the tip nut is again secured for further spraying. In each of the steps of the above operation the loosening of tip nut 11 causes the bearing surfaces of sealing member 20 to release their sealing force against nozzle 15 to freely enable nozzle 15 to rotate. The securing of tip nut 11 causes these bearing surfaces to again deform in sealing relationship against nozzle 15 so that hydraulic pressures may be applied without fear of leakage.

An alternative approach may be used in rotating handle 16 and nozzle 15 without first loosening tip nut 11, if a suitable wrench is available. A wrench may be applied against the flat surface of handle l6 to rotate the handle and nozzle 15 without the necessity of first loosening tip nut 11. This approach maintains the hydraulic seal of the bearing surfaces of sealing member 20 against the spherical surface of nozzle 15.

A further and secondary advantage has been found in the construction of handle 16, in that the flat handle surfaces provide an excellent location for stamping product identification information such as trademarks or size information relating to orifice 30. Because the handle and nozzle and spray tip after assembly are all an inseparable single part, the pertinent spray tip size information can be stamped on handle 16 for permanent future reference. Prior art devices have had this important identifying information stamped on a part which is not inseperable from the spray tip, and therefore the risk of spray tip size confusion was considerable.

The foregoing preferred embodiment of the invention represents an improvement in both cost and design for rotatable nozzles for use in conjunction with spraying devices. While obvious changes may be made within the spirit and scope of the invention, the simple, 3-component construction described herein represents an advance over the known prior art in this technological field.

What is claimed is:

1. A rotatable nozzle for use in conjunction with a spray gun for spraying paints and the like, comprising:

a. an elongated nozzle member having means for gripping and rotating at one end and having a spherical ball at the other end, said spherical ball having a passage therethrough for housing a spray orifice therein, and said passage being substantially perpendicular to the elongated member axis;

b. a nozzle holder partially enclosing said nozzle member and having a forward opening alignable with said passage, and having a rear flange adapted for clamping toward said spray gun; and c. a sealing member of deformable material, having a forward spherical annular seating surface contacting said spherical ball and having a rear flange adjacent and rearward of said nozzle holder near flange.

2. The apparatus of claim 1, further comprising means for securing said nozzle holder and said sealing member against said spray gun by clamping against said nozzle holder rear flange.

3. The apparatus of claim 2, wherein said nozzle holder further comprises a region near said forward opening having an interior spherical annular surface in contact with said spherical ball.

4. The apparatus of claim 3, wherein said sealing member seating surface further comprises a first spherical annular seating surface having a radius of curvature slightly larger than the spherical radius of said spherical ball.

5. The apparatus of claim 4, wherein the sealing member seating surface further comprises an annular notch adjacent said first spherical annular seating surface and a second spherical annular seating surface adjacent said notch.

6. The apparatus of claim 5, wherein said nozzle holder further comprises a slotted portion extending from said forward opening rearwardly along one side of said nozzle holder to a point just forward of the forward edge of said sealing member, said slot being of width slightly greater than the thickness of said elongated nozzle member.

7. The apparatus of claim 6 wherein said nozzle member passage is of a diameter less than the spherical arcuate length of said sealing member.

8. The apparatus of claim 7, wherein said sealing member is constructed of acetal homopolymer.

9. A rotatable spray nozzle assembly for attachment to a spraying device, comprising:

a. a nozzle holder having a cylindrical outer shape with a flange at one end and an axial passage therethrough, and having a second end with a slot opening said passage along a portion of said cylindrical outer shape;

b. an elongated nozzle member having a handle at one end, said handle sized to fit through said nozzle holder passage and slot, and having a spherical ball at the other end, with a passage therethrough in substantially perpendicular alignment relative to said elongated nozzle member length;

c. a spray tip, having an orifice, rigidly mounted in said elongated nozzle member passage;

d. a sealing member, having a spherical annular surface inserted in said nozzle holder in contact with said spherical ball, and having an end flange in mating contact outside said nozzle holder flange; and e. threadable means engageable against said nozzle holder flange for securing to said spraying device.

10. The apparatus of claim 9, wherein said sealing member is constructed of deformable plastic material.

11. The apparatus of claim 10, wherein said sealing member spherical annular surface is of a spherical radius slightly larger than the spherical radius of said spherical ball.

12. The apparatus of claim 11, wherein said sealing member spherical annular surface further comprises an annular slot dividing said surface into two portions.

13. The apparatus of claim 12, wherein said sealing member spherical arcuate length is greater than the diameter of said elongated nozzle member passage.

* * * * *